US005628506A

United States Patent [19]

Vaught

[11] Patent Number: 5,628,506

[45] **Date of Patent: *May 13, 1997**

[54] BREAKAWAY BASKETBALL RIM

[75] Inventor: Russell L. Vaught, Dorchester, Ill.

[73] Assignee: Schutt Manufacturing Co., Inc., Litchfield, Ill.

[ * ] Notice: The term of this patent shall not extend beyond the expiration date of Pat. No. 5,106,084.

[21] Appl. No.: 425,115

[22] Filed: Apr. 19, 1995

Related U.S. Application Data

[63] Continuation of Ser. No. 836,120, Feb. 14, 1992, abandoned, which is a continuation of Ser. No. 472,323, Jan. 30, 1990, Pat. No. 5,106,084.

[51] Int. Cl.[6] ..... A63B 63/08

[52] U.S. Cl. ..... 473/486

[58] Field of Search ..... 273/1.5 R, 1.5 A; 172/269

[56] References Cited

U.S. PATENT DOCUMENTS

| | | | |
|---|---|---|---|
| 38,233 | 4/1863 | Long | 403/162 |
| 48,069 | 6/1865 | Ingels | 172/265 |
| 75,669 | 3/1868 | De Turk | 172/271 |
| 170,627 | 11/1875 | Harris | 172/265 |
| 301,543 | 7/1884 | Wesgate . | |
| 339,632 | 4/1886 | Eubanks | 172/269 |
| 418,503 | 12/1889 | Crane | 172/266 |
| 790,410 | 6/1905 | Warne | 172/265 |
| 1,167,122 | 1/1916 | Simmons | 172/269 |
| 1,194,006 | 2/1916 | Fry | 172/265 |
| 1,253,961 | 8/1918 | Grimsrud | 172/265 |
| 1,278,074 | 9/1918 | Phelps | 403/71 X |
| 1,879,287 | 9/1932 | Johnson | 384/295 |
| 2,395,342 | 9/1946 | Morkoski | 97/184 |
| 2,506,443 | 10/1950 | Court | 97/184 |
| 2,742,843 | 12/1956 | Redetzke | 97/198 |
| 2,921,819 | 1/1960 | Rifkin | 384/439 |
| 2,935,144 | 5/1960 | Graham | 172/269 X |
| 2,964,341 | 12/1960 | Doyle et al. | 384/299 |
| 3,194,555 | 7/1965 | Humphrey | 273/1.5 R |
| 3,365,002 | 1/1968 | Jacobs | 172/269 |
| 3,402,773 | 9/1968 | Jennings et al. | 172/265 |
| 3,415,326 | 12/1968 | Cafferty et al. | 172/269 |
| 3,462,143 | 8/1969 | Bidelman et al. | 273/1.5 R |
| 3,468,382 | 9/1969 | Quanbeck | 172/264 |
| 3,721,015 | 3/1973 | Sisler et al. | 284/290 X |
| 3,765,676 | 10/1973 | Bearson et al. | 273/1.5 R |
| 3,795,396 | 3/1974 | Kropelnitski | 272/596 |
| 3,802,702 | 4/1974 | Pulley | 273/1.5 R |
| 3,881,724 | 5/1975 | Beveridge | 273/1.5 R |
| 4,026,611 | 5/1977 | Stanwell et al. | 284/439 |
| 4,111,420 | 9/1978 | Tyner | 273/1.5 R |
| 4,151,989 | 5/1979 | Dittrich | 273/1.5 A |
| 4,194,734 | 3/1980 | Tyner | 273/1.5 R |
| 4,353,548 | 10/1982 | Mahoney | 273/1.5 R |

(List continued on next page.)

FOREIGN PATENT DOCUMENTS

| | | | |
|---|---|---|---|
| 604945 | 9/1960 | Canada | 172/264 |
| 1479428 | 3/1967 | France . | |
| 2515767 | 9/1970 | Germany . | |
| 286216 | 2/1965 | Netherlands . | |
| 613310 | 11/1948 | United Kingdom | 172/269 |
| 908055 | 10/1962 | United Kingdom . | |

OTHER PUBLICATIONS

"Toss Back grant may bring 20 new jobs to Dorrance," newspaper article (date unknown).

"Toss Back, Factory Direct Pricing," product brochure (data unknown).

"Western basketball coach invents dunk safe rim," newspaper article (date unknown).

"Toss Back's products score on the courts," newspaper article (date unknown).

(List continued on next page.)

*Primary Examiner*—Paul E. Shapiro

*Attorney, Agent, or Firm*—Brinks Hofer Gilson & Lione

[57] ABSTRACT

A breakaway basketball goal is disclosed. In one aspect of the invention the goal includes rim structure which pivots about self-lubricating bearings when a predetermined force is applied to the rim.

22 Claims, 2 Drawing Sheets

U.S. PATENT DOCUMENTS

| | | | |
|---|---|---|---|
| 4,365,802 | 12/1982 | Ehrat | 273/1.5 R |
| 4,438,923 | 3/1984 | Engle et al. | 273/1.5 R |
| 4,441,709 | 4/1984 | Schroeder et al. | 273/1.5 R |
| 4,534,556 | 8/1985 | Estlund et al. | 273/1.5 R |
| 4,588,188 | 5/1986 | Mahoney et al. | 273/1.5 R |
| 4,676,503 | 6/1987 | Mahoney et al. | 273/1.5 R |
| 4,723,777 | 2/1988 | Jolly | 273/1.5 R |
| 5,066,007 | 11/1991 | Niver | 273/1.5 R |
| 5,106,084 | 4/1992 | Vaught | 273/1.5 R |

OTHER PUBLICATIONS

"Scouting," The New York Times (Nov. 23, 1985).
"Economic Development Reported," newspaper article (date unknown).
"Inside the NBA," magazine article (date unknown).
"Dunkers Are Strutting Their Stuffs," Sports Illustrated (Mar. 14, 1977).
"The Year of the Superstuffers," Time (Mar. 21, 1977).
"Game Time, Inc." product brochure (1976).
"Miracle Recreation Equipment Company, 1977 Catalog," product brochure (1977).
"The Dunk?", Sun Times (Mar. 6, 1977).
"The Dunk is back?. . . and Illinois State has it?", brochure.
"Wesleyan cagers play tonight," newspaper article (1976).
"Gared Company, Athletic Equipment No. 878," product brochure (date unknown).
Basketball Products, Inc. product brochure (date unknown).
U.S. Patent Application Ser. No. 07/837,324 by Vaught, filed Feb. 18,1992.
"Slam Dunk Rim, Inc." product brochure (date unknown).

BREAKAWAY BASKETBALL RIM

This application is a continuation of application Ser. No. 07/836,120, filed Feb. 14, 1992, abandoned, which is a continuation of application Ser. No. 07/472,323, filed Jan. 30, 1990, now U.S. Pat. No. 5,106,084.

BACKGROUND OF THE INVENTION

This invention relates to basketball goals in general, and in particular to basketball goals of the type which have what is commonly referred to as a breakaway rim. Breakaway rims have become increasingly popular, not only because they are believed by some to reduce damage to backboards, especially when players slam or "dunk" a basketball through the hoop, but because the sight of the rim pivoting downwardly during heated play is apparently particularly appealing to many spectators of the game.

In the past there have been numerous attempts to design and develop basketball goals having breakaway rims. Some of these attempts have been described in U.S. Pat. Nos. 4,111,420; 4,365,802; 4,534,556; and 4,676,503. Though these attempts have achieved varying degrees of success and/or acceptance, they are nonetheless subject to certain drawbacks. These drawbacks relate, for example, to the location and geometry of the component parts, and the susceptibility of such parts to damage and wear.

Accordingly, it is a primary object of this invention to provide an improved basketball goal of the type utilizing a breakaway rim. In particular, it is an object of this invention to provide a basketball goal of the type described wherein some of the component parts are more resistant to damage and wear, and/or have different arrangements which permit more efficient or reliable operation and use.

SUMMARY OF THE INVENTION

The foregoing objects of the invention, along with various features and advantages, are achieved in a basketball goal having support structure adapted to be mounted to a backboard, and rim structure including a rim, mounted to the support structure. In one aspect of the invention the basketball goal further includes a rim support assembly including a clamp, a spring and a rigid member. The clamp is mounted to the rim support assembly and has a clamped position for maintaining the rim in a horizontal position, and an unclamped position enabling the rim to swing downwardly in an arcuate path. The spring is operatively mounted to the clamp for maintaining the clamp in the clamped position, and for permitting the clamp to assume the unclamped position and move in the arcuate path upon application of a predetermined force to the rim. The rigid member supports the spring, and is mounted for swinging movement along another arcuate path upon application of the predetermined force to the rim, thereby preventing damage to the spring when the clamp assumes the unclamped position.

In another aspect of the invention, the basketball goal includes support structure adapted to be mounted to a backboard, and rim structure, including a rim, mounted to the support structure for pivotal movement from a horizontal position, wherein the rim is substantially horizontal, to a second position wherein the rim is inclined from the horizontal. The support structure and the rim structure define a pair of concentric bearing openings which define an axis for pivotal movement of the rim. A pair of bearings are located, respectively, in the bearing openings to reduce the friction caused by the pivotal movement of the rim about the axis.

In other aspects of the invention, the bearings are self-lubricating, and have concave surfaces which are matingly engaged by convex surfaces of respective bolts used to mount the bearings in their respective bearing openings. Further aspects of the invention will become apparent upon reading the following detailed description of the exemplary embodiments of the invention in conjunction with the accompanying drawings.

DETAILED DESCRIPTION OF THE DRAWINGS

Exemplary embodiments of the invention are shown in the following drawings wherein.

DETAILED DESCRIPTION OF EXEMPLARY EMBODIMENTS

Figure 1:
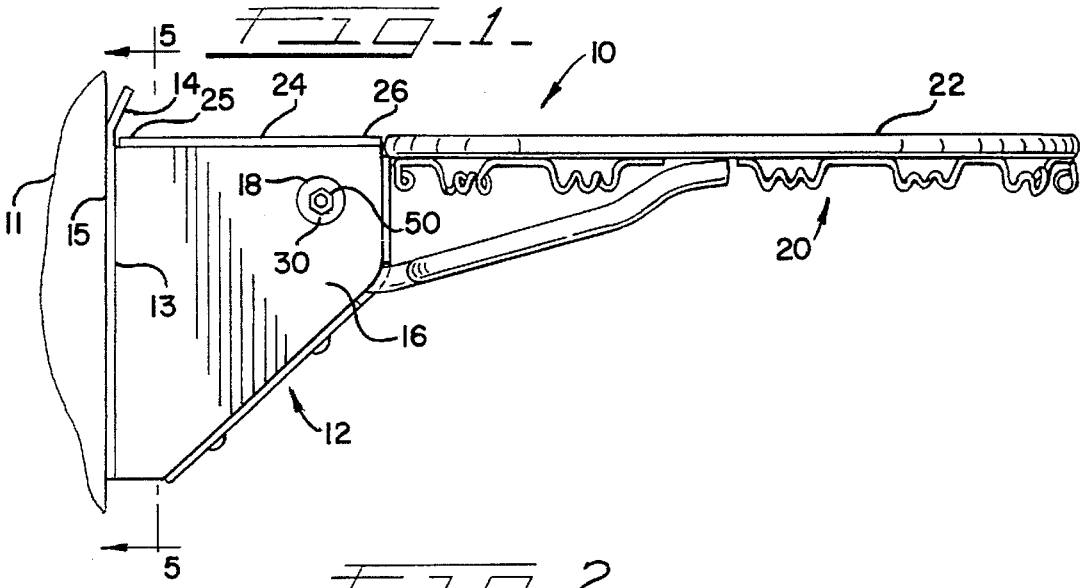
FIG. 1 is side view of an exemplary embodiment of the breakaway basketball rim incorporating the invention.
Figure 2:
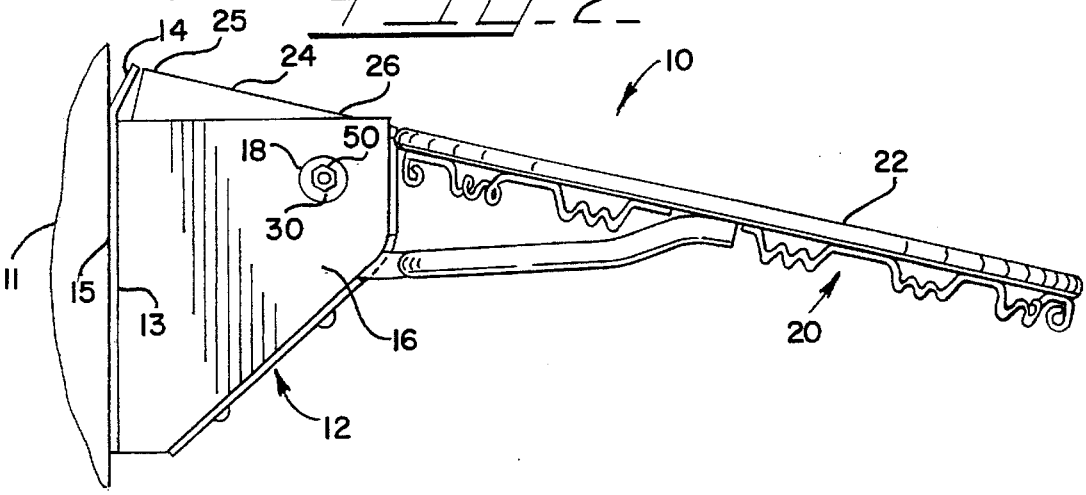
FIG. 2 is a side view of the embodiment shown in FIG. 1 with the rim in a breakaway position inclined from the horizontal.
Figure 3:
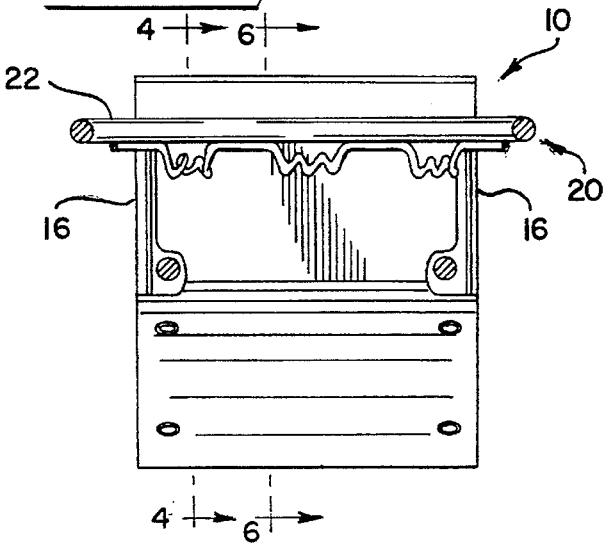
FIG. 3 is a front view of the embodiment shown in FIG. 1.

Referring now to FIGS. 1–, there is shown a basketball goal 10 of the type that is adapted to be mounted to a backboard 11 for playing the game of basketball. The basketball goal 10 includes a support structure 12 having a stationary rigid base 14 defining an interior surface 13 and an exterior surface 15. Rigid base 14 is adapted to be placed with its exterior surface 15 in flush, facing relation with backboard 11. The support structure 12 further includes a pair of ears 16, each defining a first opening 18, extending outwardly from the stationary rigid base 14.

Figure 5:
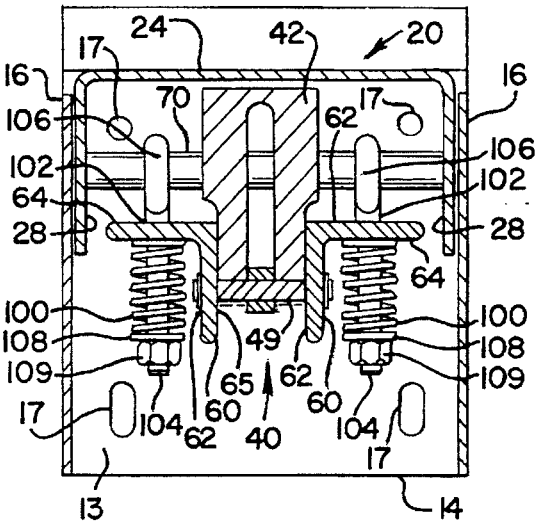
FIG. 5 is a sectional view partially cutaway, of the embodiment of FIG. 1, taken along lines 5—5 thereof.

Stationary rigid base 14 preferably defines several mounting apertures 17 which are shown best in FIG. 5. Apertures 17 are alignable with corresponding openings (now shown) in the backboard 11. To facilitate alignment with the openings in the backboard 11, some of the mounting apertures 17 may be formed in an elongated or oblong shape if desired. Bolts (not shown) are then passed through apertures 17 and the corresponding aligned openings in the backboard 11, and secured by nuts (not shown) to firmly mount the basketball goal 10 to the backboard 11.

The basketball goal 10 further includes a rim structure 20 mounted for releasably pivotal movement relative to the support structure 12 by a rim support assembly 40 shown in FIGS. 4–7. Rim structure 20 has an outwardly extending neck portion 24 and a rim 22. Neck portion 24 defines a proximal end 25 located adjacent the stationary rigid base 14, and a distal end 26 to which rim 22 is secured. The neck portion 24 and the rim 22 are preferably of such size and shape as to conform with the official rules and regulations for the game of basketball.

Figure 8:
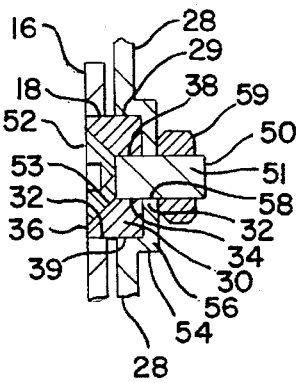
FIG. 8 is a sectional view of a portion of a mounting assembly for the rim shown in the embodiment of FIG. 1.

As shown, for example, in FIG. 8, rim structure 20 further includes a pair of flanges 28 extending downwardly from the neck portion 24, interiorly of and adjacent to corresponding ears 16 of support structure 12. Each of flanges 28 defines a second opening 29, concentric with and adjacent to the corresponding first opening 18 in each of ears 16. The space defined by each one of the first openings 18 and a respective adjacent one of the second openings 29 defines a bearing opening 39, adapted to receive a bearing as explained hereinafter. Thus, in this preferred embodiment, two bearing openings 39 are formed, one in each of the ears 16 extending from support structure 12. Bearing openings 39 define an axis about which the rim structure 20 may pivot relative to the support structure 12.

Still referring to FIG. 8, second openings 29 are preferably formed by corresponding recesses 54 in flanges 2, each of recesses 54 being substantially closed off by an interior wall 56. Each interior wall 56 defines a hole 58 for receiving a bearing-mounting bolt 50. Each bearing mounting bolt 50 comprises a threaded shank 51 and a head 52. Preferably head 52 of bolt 50 is characterized by an interior convex surface 53.

In this preferred embodiment, the basketball goal also includes bearing structure in the form of a pair of substantially disk-shaped bearings 30, each having a center hole 38. Each of bearings 30 has a circumferential bearing surface 32, a substantially flat interior face or surface 34, and an exterior face or surface 36. Exterior surface 36 is preferably concave, and formed to be matingly engagable by the convex surface 53 of bearing-mounting bolt 50. Further, bearings 30 are preferably made of self-lubricating material such as graphite or impregnated plastic.

Each of bearings 30 is mounted within a corresponding one of the two bearing openings 39, with the interior surface 34 in facing relation with a corresponding interior wall 56. Bearings 30 are maintained in that position by inserting the threaded shank 51 of bolt 50 through both the center hole 38 of bearing 30 and the hole 58 in the interior wall 56 of recess 54. A nut 59 is then tightened onto the end of the threaded shank 51 protruding through the hole 58. When so tightened, the convex surfaces 53 of bolts 50 are against the concave exterior surface 36 of bearings 30, resulting in a firm fit of bearings 30 in their respective bearing openings 39. Thus, the bearing surface 32 of each bearing 30 is accurately positioned relative to the edges of the ears 16 and the flanges 28 defined by the first opening 18 and the second opening 29, respectively.

When bearings 30 are so mounted, they define pivot points for the rim structure 20 to move relative to the support structure 12. Since the bearings 30 are firmly maintained in their respective bearing openings 39 in the manner described, such pivotal movement will occur in a smooth, consistent manner. Moreover, since the bearings 30 are self-lubricating, these movements can be reliably repeated almost indefinitely, without need for adjustment or maintenance. Further, these beneficial results are achieved without cluttering the interior mechanism of the goal 10 with additional mechanical structures, which could interfere with the operation of the goal and/or its mounting to the backboard.

As previously mentioned, the pivotal movement of rim structure 20 relative to support structure 12 is accomplished, at least in part, by the rim support assembly 40. As shown in FIGS. 4–7, rim support assembly 40 includes a pair of L-shaped brackets 60 each having a first leg 62 and a second leg 64. Each bracket 60 is fixedly secured to the interior surface 13 of rigid base 14 with their first legs 62 being substantially parallel and separated by a gap 65 shown in FIG. 5. The second legs 64 of brackets 60 extend in opposite directions toward respective flanges 28.

Figure 4:
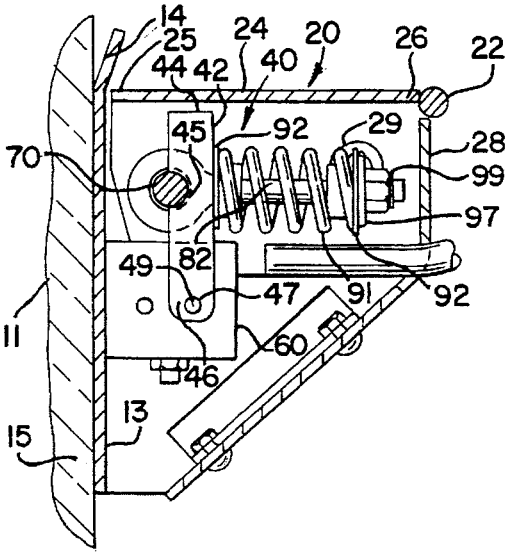
FIG. 4 is a sectional view of the embodiment of FIG. 1, taken along lines 4—4 of FIG. 3.

Rim support assembly 40 further includes a unitary clamp 42, disposed in the gap 65, having a free upper end 44 and a pivoted lower end 46 shown best in FIG. 4. A shaft opening 47 is defined in the lower end 46 of clamp 42, and is adapted to receive a pin 49 having its ends secured, respectively, to the first legs 62 of brackets 60. When clamp 42 is mounted in the manner described, it is able to pivot about pin 49 with its upper end 44 defining an arcuate path when such pivoting occurs.

Clamp 42 is adapted to cooperate with a locking element, such as a catch 70, the ends thereof being fixedly secured to respective flanges 28, and being spaced above the interior surface 13 of rigid base 14, all as shown in FIG. 4. Catch 70 may have any desired cross-sectional shape, such shape being circular in this particular embodiment. Disposed near the upper end 44 of clamp 42 is a mating receiving element or mating portion such as cut-out 45 which is preferably contoured to substantially correspond to the cross-sectional shape of catch 70. Thus, in this embodiment, cut-out 45 is substantially of a semi-circular contour as shown, for example, in FIG. 4.

Figure 9:
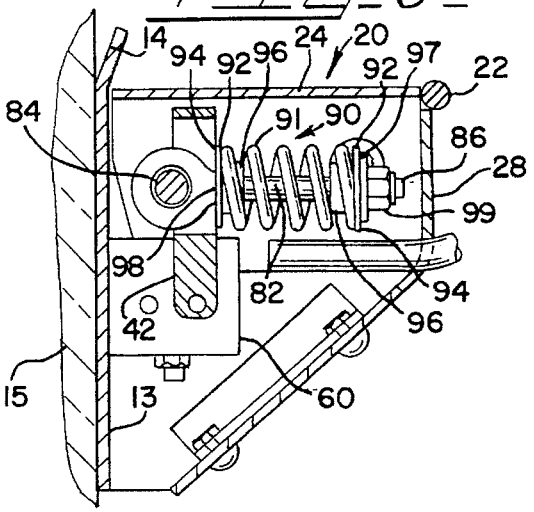
FIG. 9 is a view of another portion of the mounting assembly for the rim shown in the embodiment of FIG. 1.

Rim support assembly 40 also includes a rigid member which, in this exemplary embodiment, is an eyebolt 82. As shown best in FIG. 9, eyebolt 82 has one end defining a loop 84 and a threaded end 86. Catch 70 extends through the loop 84 of eyebolt 82, thereby enabling the threaded end 86 of eyebolt 82 to pivotably move in an arcuate path about catch 70 when a breakaway force is applied to rim 22.

In this exemplary embodiment rim support assembly 40 further includes a spring assembly 90. As shown best in FIG. 9, spring assembly 90 desirably includes a coiled spring 91 defining an inner diameter, and a pair of mounting washers 92. Each of mounting washers 92 has an eyebolt-receiving hole 98, a flat exterior surface 94 and a raised cylindrical portion 96 somewhat smaller in diameter than the inner diameter defined by the coiled spring 91.

In assembly, the eyebolt-receiving hole 98 of one of the mounting washers 92 is placed over the eyebolt 82, and the mounting washer is pushed inwardly until the flat exterior surface 94 rests against the clamp 42. The coiled spring 91 is then placed about eyebolt 82 and pushed inwardly until the raised cylindrical portion 96 of mounting washer 92 is disposed inside at least a portion of the lower-most coil of spring 91, and the exterior surface 94 rests against clamp 42. The other mounting washer is then placed over eyebolt 82 with its raised cylindrical portion 96 disposed within at least a portion of the upper-most coil of spring 91. A metal washer 97 is then placed over the threaded end of eyebolt 82, resting against the exterior surface 94 of the last-mentioned mounting washer 92. A nut 99 is then screwed onto the threaded end of eyebolt 82 with a tightness which predetermined the amount of force that must be applied to rim 22 in order to achieve a desired breakaway condition. In other words, when nut 99 is tightened onto the threaded end 86 of eyebolt 82, coiled spring 91 is compressed to a predetermined tension, thereby establishing a predetermined breakaway force.

Figure 7:
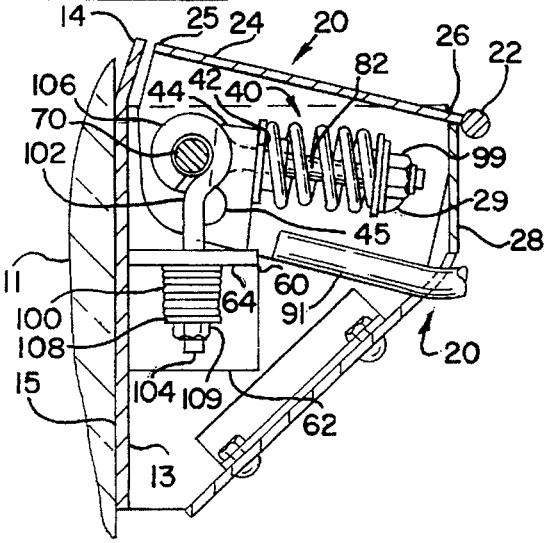
FIG. 7 is a sectional view, partially cutaway, of the embodiment of FIG. 1 with the rim in the breakaway position shown in FIG. 2.

When the spring assembly 90 is properly assembled, the catch 70 will be captured by the cut-out 45 in the clamp 42. When so captured, the rim support assembly 40 supports and substantially immobilizes the entire rim structure 20, including flanges 28, neck portion 24 and rim 22, in a first, clamped position wherein the rim 22 extends outwardly in a substantially horizontal position. When the predetermined breakaway force, typically about 230 pounds, is applied to the rim 22, spring 91 flexes, and eyebolt 82 pivotably moves in the arcuate path previously described. This movement, in turn, releases the catch 70 from the clamp 42. When so released, the rim structure 20 will pivotably move in an arcuate path about the pivot points defined by bearings 30. As such, rim 22 will move from a substantially horizontal position to an unclamped position, inclined from the horizontal. As seen in FIG. 7, when the rim is in an unclamped position cut-out 45 is disengaged from catch 70 such that a resting portion of the clamp 42 lies on the catch 70 at a resting position. Furthermore, because both the eyebolt 82 and the rim structure 20 move in an arcuate path, when the catch 70 is released from the clamp 42, the chance of causing damage to the eyebolt 82, the spring 91, or any of the other components of goal 10, is minimized.

Figure 6:
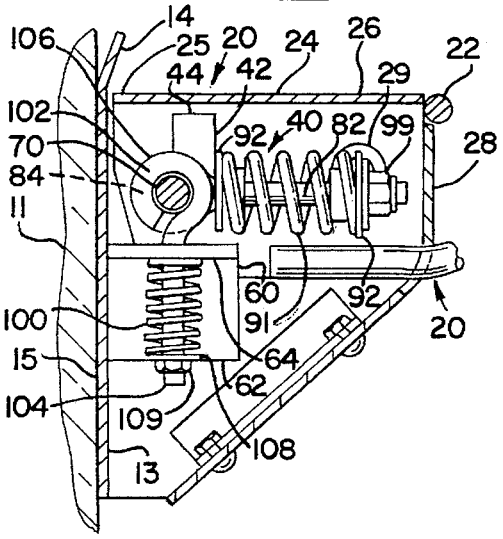
FIG. 6 is a sectional view, partially cutaway, of the embodiment of FIG. 1, taken along lines 6—6 of FIG. 3.

As shown in FIGS. 5–7, the basketball goal 10 further includes a pair of return springs 100 used to return the rim 22 to its original, horizontal position when the breakaway force applied thereto is released. Both of springs 100 are mounted in place by an eyebolt 102, each eyebolt 102 having a threaded end 104 and a looped end 106. In assembly, the catch 70 extends through the looped end 106 of each one of eyebolts 102 which are located on opposite sides of loop 84 of eyebolt 82. Each of the eyebolts 102 also extends through an appropriately located and dimensioned hole defined in the second leg 64 of each L-shaped bracket 60, and through the length of a corresponding one of springs 100. A washer 108 is placed over the threaded end 104 of each eyebolt 102, and a nut 109 is tightened thereon.

The return force to be applied by springs 100 is determined by the tightness of the nuts 109. Preferably, this force is substantially less than the predetermined breakaway force previously described, but sufficient to urge the rim structure 20 to pivotably move in the opposite direction about bearings 30 until clamp 42 again captures catch 70. When this occurs, rim 22 will, of course, be returned to its horizontal clamped position.

What has been described is a novel basketball goal of the type utilizing a breakaway rim. As explained, this goal, and its various components, minimize damage and wear, and permit reliable operation and use. Though the exemplary embodiments described herein are preferred, it is contemplated that other embodiments which do not part from the true scope of the invention, will become apparent to those skilled in the art. Accordingly, all such embodiments, are intended to be covered by the appended claims.

I claim:

1. A basketball goal comprising:

support structure adapted to be mounted to a backboard;

a rim structure, including a rim, mounted to said support structure;

a rim support assembly including a locking element and a mating receiving element provided on a clamp, said locking element and said mating receiving element having a clamped position wherein said locking element and said mating receiving element are engaged for maintaining said rim in a horizontal position, and an unclamped position wherein said locking element and said mating receiving element are disengaged, enabling said rim to swing downwardly in an arcuate path; and a coiled spring, mounted to provide a bias between said locking element and said mating receiving element for maintaining said locking element and said mating receiving element in said clamped position, wherein said locking element in said clamped position only receives a bias from said coiled spring along a single direction, and wherein said coiled spring permits said locking element and said mating receiving element to disengage upon application of a predetermined force to said rim; and wherein said clamp further comprises a resting portion which said locking element engages when said locking element and said mating receiving element disengage.

2. The basketball goal as set forth in claim 1, wherein said coiled spring permits said locking element to engage the resting portion when said locking element and said mating receiving element disengage.

3. The basketball goal as set forth in claim 1, wherein said locking element comprises a cylindrically shaped member.

4. The basketball goal as set forth in claim 1, wherein said locking element comprises a shaft.

5. A basketball goal comprising:

support structure adapted to be mounted to a backboard;

a rim structure, including a rim, mounted to said support structure;

a rim support assembly including a locking element and a mating receiving element, said locking element and said mating receiving element having a camped position wherein said locking element and said mating receiving element are engaged for maintaining said rim in a horizontal position, and an unclamped position wherein said locking element and said mating receiving element are disengaged, enabling said rim to swing downwardly in an arcuate path;

a coiled spring, mounted to provide a bias between said locking element and said mating receiving element for maintaining said locking element and said mating receiving element in said clamped position, wherein said locking element in said clamped position only receives a bias from said coiled spring along a single direction, and wherein said coiled spring permits said locking element and said mating receiving element to disengage upon application of a predetermined force to said rim; and a spring attachment device for attaching said coiled spring to said rim structure and enabling said coiled spring to swing in an arcuate path when said locking element and said mating receiving element disengage.

6. The basketball goal as set forth in claim 5, wherein said locking element comprises a cylindrically shaped member.

7. The basketball goal as set forth in claim 5, wherein said locking element comprises a shaft.

8. The basketball goal as set forth in claim 5, wherein said coiled spring permits said locking element to engage the resting portion when said locking element and said mating receiving element disengage.

9. A basketball goal comprising:

support structure adapted to be mounted to a backboard;

a rim structure, including a rim, mounted to said support structure;

a rim support assembly including a locking element, a clamp including a mating portion, said clamp having a clamped position wherein said locking element and said mating portion of said clamp are in a biased relationship for maintaining said rim in a horizontal position, and an unclamped position wherein said mating portion of said clamp is disengaged from said locking element enabling said rim to swing downwardly in an arcuate path;

a coiled spring, mounted to provide said biased relationship by having said spring bias said locking element against said mating portion of said clamp when said clamp is in said clamped position, wherein said locking element in said clamped position only receives a bias from said coiled spring along a single direction, and for permitting said clamp to assume said unclamped position with said locking element disengaged from said mating portion; and wherein said clamp further comprises a resting portion which said locking element engages when said clamp is in said unclamped position.

10. The basketball goal as set forth in claim 9, wherein said coiled spring permits said locking element to engage the resting portion when the clamp is in said unclamped position.

11. The basketball goal as set forth in claim 9, wherein said locking element comprises a cylindrically shaped member.

12. The basketball goal as set forth in claim 9, wherein said locking element comprises a shaft.

13. A basketball goal comprising:

support structure adapted to be mounted to a backboard;

a rim structure, including a rim, mounted to said support structure;

a rim support assembly including a locking element, a clamp including a mating portion, said clamp having a clamped position wherein said locking element and said mating portion of said clamp are in a biased relationship for maintaining said rim in a horizontal position, and an unclamped position wherein said mating portion of said clamp is disengaged from said locking element enabling said rim to swing downwardly in an arcuate path;

a coiled spring, mounted to provide said biased relationship by having said spring bias said locking element against said mating portion of said clamp when said clamp is in said clamped position, wherein said locking element in said clamped position only receives a bias from said coiled spring along a single direction, and for permitting said clamp to assume said unclamped position with said locking element disengaged from said mating portion; and a spring attachment device for attaching said coiled spring to said rim structure and enabling said coiled spring to swing in an arcuate path when said locking device is disengaged from said mating portion of said clamp.

14. The basketball goal as set forth in claim 13, wherein said locking element comprises a cylindrically shaped member.

15. The basketball goal as set forth in claim 13, wherein said locking element comprises a shaft.

16. The basketball goal as set forth in claim 13, wherein said coiled spring permits said locking element to engage the resting portion when the clamp is in said unclamped position.

17. A basketball goal comprising:

support structure adapted to be mounted to a backboard;

a rim structure, including a rim, mounted to said support structure; and a rim support assembly including:

a shaft, a clamp including a mating portion, said clamp having a clamped position wherein said shaft engages said mating portion of said clamp for maintaining said rim in a horizontal position, and said clamp having an unclamped position wherein said mating portion of said clamp and said shaft disengage from each other enabling said rim to swing downwardly in an arcuate path;

a coiled spring, operatively mounted to said clamp, for maintaining said clamp in said clamped position, wherein said shaft in said clamped position only receives a bias from said coiled spring along a single direction, and for permitting said clamp to assume said unclamped position; and wherein said clamp further comprises a resting portion which said shaft engages when said clamp is in said unclamped position.

18. The basketball goal as set forth in claim 17, wherein said coiled spring permits said shaft to engage the resting portion when the clamp is in said unclamped position.

19. The basketball goal as set forth in claim 18, wherein said shaft is cylindrically shaped.

20. A basketball goal comprising:

support structure adapted to be mounted to a backboard;

a rim structure, including a rim, mounted to said support structure; and a rim support assembly including:

a shaft, a clamp including a mating portion, said clamp having a clamped position wherein said shaft engages said mating portion of said clamp for maintaining said rim in a horizontal position, and said clamp having an unclamped position wherein said mating portion of said clamp and said shaft disengage from each other enabling said rim to swing downwardly in an arcuate path;

a coiled spring, operatively mounted to said clamp, for maintaining said clamp in said clamped position, wherein said shaft in said clamped position only receives a bias from said coiled spring along a single direction, and for permitting said clamp to assume said unclamped position; and a spring attachment device for attaching said coiled spring to said rim structure and enabling said coiled spring to swing in an arcuate path when said shaft is disengaged from said mating portion of said clamp.

21. The basketball goal as set forth in claim 20, wherein said shaft is cylindrically shaped.

22. The basketball goal as set forth in claim 20, wherein said coiled spring permits said shaft to engage the resting portion when the clamp is in said unclamped position.

* * * * *

UNITED STATES PATENT AND TRADEMARK OFFICE

CERTIFICATE OF CORRECTION

PATENT NO. : 5,628,506
DATED : May 13, 1997
INVENTOR(S) : Russell L. Vaught

It is certified that error appears in the above-identified patent and that said Letters Patent is hereby corrected as shown below:

On the Title Page

Page 2, Column 1, after line 9, under "U.S. PATENT DOCUMENTS", insert --5,348,289 9/1994 Vaught--.

Signed and Sealed this

Seventeenth Day of July, 2001

*Attest:*

Nicholas P. Godici

*Attesting Officer*

NICHOLAS P. GODICI
*Acting Director of the United States Patent and Trademark Office*